US006968987B1

(12) United States Patent
Reitano

(10) Patent No.: US 6,968,987 B1
(45) Date of Patent: Nov. 29, 2005

(54) QUARTERING PILL SPLITTER

(75) Inventor: Carmen T. Reitano, Salisbury, MA (US)

(73) Assignee: Three Chestnuts Technologies, Inc., Wilmington, DE (US)

( * ) Notice: Subject to any disclaimer, the term of this patent is extended or adjusted under 35 U.S.C. 154(b) by 0 days.

(21) Appl. No.: 10/604,784

(22) Filed: Aug. 15, 2003

(51) Int. Cl.[7] ..... B26F 3/00
(52) U.S. Cl. ..... 225/1; 30/120.2; 225/89; 225/103
(58) Field of Search ..... 83/932, 857, 620, 83/856, 858; 225/1, 103, 104, 89, 105, 120.2, 225/185, 241

(56) References Cited

U.S. PATENT DOCUMENTS 2,852,053 A * 9/1958 Inez et al. ..... 83/435.15
3,048,208 A * 8/1962 Umanoff ..... 30/120.3
5,634,272 A * 6/1997 Samuelson ..... 30/120.3
6,041,697 A * 3/2000 Maoz ..... 99/572
6,474,525 B1 11/2002 Reitano ..... 225/1
6,644,528 B1 * 11/2003 Reitano ..... 225/1

* cited by examiner

*Primary Examiner*—Allan N. Shoap
*Assistant Examiner*—Isaac N Hamilton
(74) *Attorney, Agent, or Firm*—Mark P. White

(57) ABSTRACT

A quartering pill splitter includes a bed having a recess formed within, the recess having a cross section which substantially conforms to the pill shape. A thin, cruciate cutting blade assembly is disposed below the pill bed, so that the pill, when inserted into the recess, rests on the cutting edges of the cruciate cutting blade assembly. A plunger, containing an upper compression member is moveable with respect to the cutting blade assembly and is forceably engaged against the pill disposed in the bed recess when the user strikes the cap of the plunger, thus cutting the pill into quarters in a single stroke. The cruciate cutting blade assembly contains a first blade and a second blade at a right angle relative to the first blade, and which is offset from the first blade a distance equal to the thickness of the first blade.

6 Claims, 1 Drawing Sheet

QUARTERING PILL SPLITTER

BACKGROUND OF INVENTION

Pill splitters are common in the prior art, and are quite popular at the present time, especially because of the constantly increasing cost of prescription drugs, and the failure, or impossibility, of many users to obtain insurance which pays for much or all of their medication.

Many medications are marketed and priced in a limited variety of dosages whereas many patients require dosages that do not correspond to the standard dosages available from the manufacturers. In addition many medications are available in several different dosages, but with prices which do not vary proportionately to the dosage. In both instances, splitting pills of existing dosages ameliorates the problems presented.

Prior art pill splitters have addressed both problems. A pill splitter effective with Viagra pills, for instance, was the subject of U.S. Pat. No. 6,474,525, intended for customers dealing with the second of these problems.

Viagra is marketed in three different dosages: 25, 50, and 100 mg, all three of which are sold at the same price. Thus, a user having a prescribed dosage of 25 mg. could quarter the cost of his medication by purchasing one quarter the number of 100 mg pills, and splitting them in quarters.

A search of the prior art does not reveal any prior art quartering pill splitters of this nature. The present invention provides a quartering pill splitter, and includes the custom pill bed features of U.S. Pat. No. 6,474,525 effective for splitting pills which have different, complex shapes.

The present invention has been shown to accurately split a pill in four equal parts, resulting in precisely calibrated dosages.

SUMMARY OF INVENTION

It is an object of the present invention to provide a pill splitter which will split a pill into quarters with a single operation. It is a further object of this invention to provide such a pill splitter which contains a pill bed which securely holds the pill in position to be split, and which corresponds to the shape of the pill.

In accordance with one aspect of the present invention, the pill splitter includes a bed having a recess formed within, the recess having a cross section which substantially conforms to the pill shape.

In accordance with a second aspect of the current invention a thin cruciate cutting blade assembly, affixed in proximity to the bed, is provided.

In accordance with a third aspect of the current invention an upper compression member moveable with respect to the cutting blade assembly is provided.

In accordance with a fourth aspect of the current invention means to forceably engage the upper compression member against a pill disposed in the bed recess are provided.

In accordance with a fifth aspect of the current invention the cruciate cutting blade assembly further includes a first blade having a thickness and a second blade at a substantially right angle relative to the first blade.

In accordance with a sixth aspect of the current invention, the second blade is offset from the first blade by a distance approximately equal to the thickness of the first blade.

In accordance with a seventh aspect of the current invention the pill splitter includes a lower body containing the cutting blade assembly, and an upper body, integrally affixed to the lower body, and containing one or more linear plunger guides slots.

In accordance with an eighth aspect of the current invention a plunger is included which contains plunger guides which slidingly engage the plunger guide slots, and wherein the compression member is integrally formed at a lower end of the plunger.

In accordance with a ninth aspect of the current invention the bed is substantially cylindrical in form.

In accordance with a tenth aspect of the current invention the bed further includes guide tabs for aligning the recess in the bed with the cutting blade so that the guide tabs matingly engage the guide tabs with the linear plunger guide slots of the upper body.

In accordance with an eleventh aspect of the current invention the cutting blade assembly is disposed directly below the bed.

BRIEF DESCRIPTION OF DRAWINGS

These, and further features of the invention, may be better understood with reference to the accompanying specification and drawings depicting the preferred embodiment, in which.

DETAILED DESCRIPTION

The current invention is intended for use with pills which have complex shapes, with or without scoring in the center. In addition to the features provided in the pill splitters of the present inventor, which have been subject of U.S. patents application Ser. No. 10/248,043, the present invention will split pills into quarters. The section of said Application entitled Description of the Preferred Embodiments is hereby incorporated by reference into this section, for the purpose of more fully describing the operation of the present pill splitter. The present pill splitter differs from said prior art pill splitter only in that the present pill splitter incorporates a cruciate cutting blade assembly, as opposed to the prior art linear blade, and further that the bed of the current invention is disposed atop the pill bed.

Figure 2:
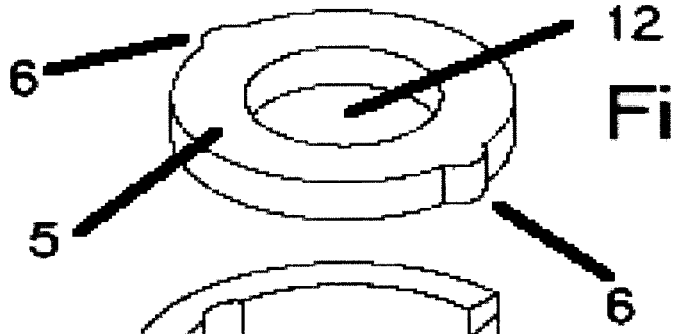
FIG. 2 depicts a perspective view of the pill-splitter bed.

Like the previous pill splitters of the patents referenced above, the present pill splitter securely supports the pill during the splitting operation by forming a bed corresponding to the shape of the pill to be split in three dimensions. Referring now to FIG. 2, the bed 5 will have substantially the same cross section as the pill to be split. The bed is affixed within the splitter lower body 9, which is cylindrical in this embodiment, and is integrally attached to the upper body 10, which contains opposing guide slots 11.

Figure 1:
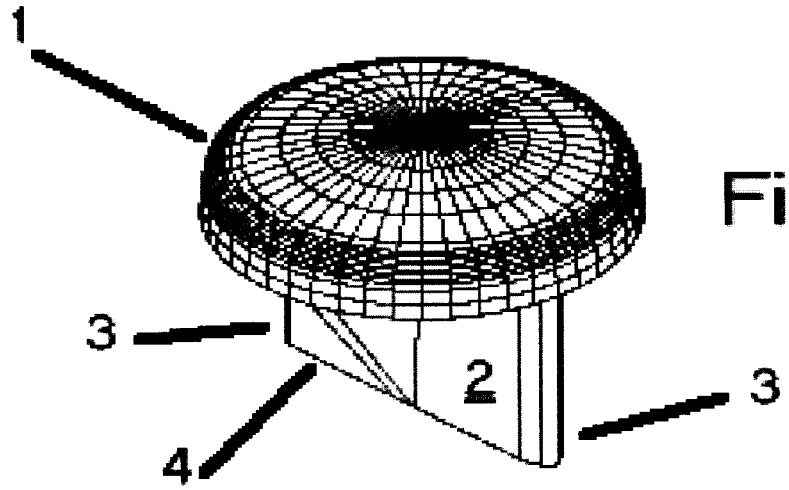
FIG. 1 depicts a perspective view of the pill-splitter plunger.

A Plunger is shown in the drawing of FIG. 1, having a plunger cap 1, and plunger body 2, which has plunger guides 3 integrally formed on either side of the plunger body. In operation, these guides mate with guide slots 11. Further, the pill bed 5 contains its own guide tabs 6, which also mate with the guide slots 11 when the pill splitter is assembled. In the preferred embodiment the pill bed is permanently affixed to either the upper or lower body of the pill splitter.

Figure 3:
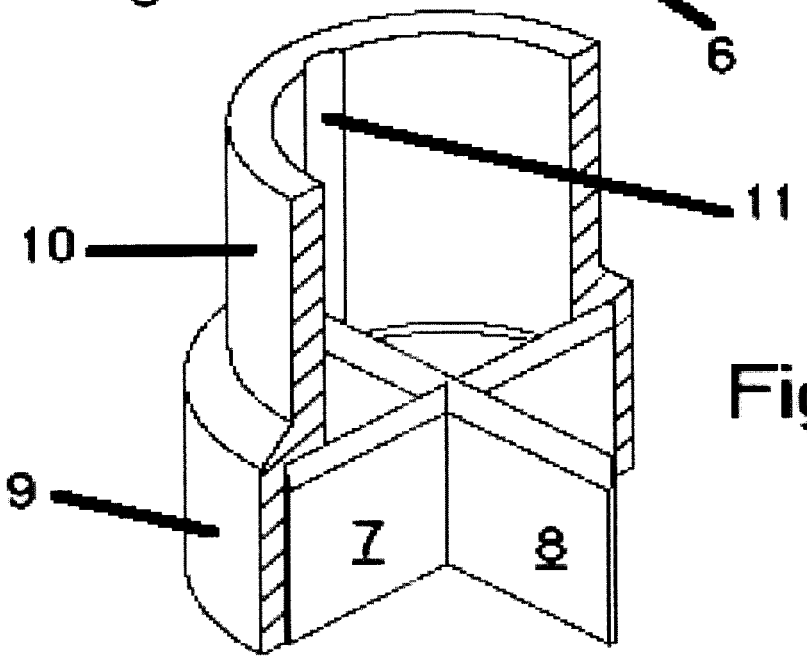
FIG. 3 depicts a cut-away perspective view of the pill splitter upper and lower body, with the cruciate cutting blade inserted in the lower body.

The major feature new to this invention is the inclusion of a cruciate, or cross-shaped, cutting blade assembly, as shown in FIG. 3. The cutting blade assembly is formed from two blades: a first blade 7 and a second blade 8, disposed at right angles to the first blade. The blades may be made of stock the thickness of razor blades or somewhat larger. A typical thickness of the blades used in this invention is 0.025 inches.

When the pill is placed in the recess 12 of the pill bed 5, the pill rests on the cutting blade assembly. The plunger is then lowered until the lower edge of the plunger 4, which forms a compression member, is in contact with the pill. The user then strikes a sharp blow with the heel of the hand against the plunger cap, driving the compression member downward onto the pill, and driving the bottom of the pill onto the cruciate cutting assembly.

It has been further found that the pill splitter performance is improved if the cutting edge of the first blade 7 is slightly offset from the cutting edge of the second blade 8, so that the pill rests entirely on the cutting edge of the second blade when the pill is disposed within the recess 12 of the bed 5. Referring again to FIG. 3, it may be seen that the cutting edge of the second blade 8 is higher, or protrudes further toward the top of the upper body, and further toward the pill bed 5, than does the cutting edge of the first blade 7. In practice both the first and second blades have the same thickness. It has been found that this vertical offset between the two blades is most effective when it is between the width of the cutting blades, and twice that width.

In this second embodiment, it has been found that the when the plunger is driven down against the pill, the pill first splits along an axis parallel to the second blade, and the resulting two halves continue moving downward and then split along the perpendicular axis formed by the perpendicular cutting blade 7.

In this second embodiment, it has been found that when the plunger is driven down against the pill, the pill serially engages blade 8 and splits into two equal doses, then the resulting two pill halves continue moving downward and engage blade 7 splitting the pill halves into equal quarters.

In further embodiments the cruciate cutting assembly may contain more than two blades, and the blades need not be at right angles to each other.

In contrast to many pill splitters of the prior art, the current invention contains only a single blade assembly, located below the pill bed. It has been found that the plunger need not contain a sharpened cutting edge, so long as the bottom edge of the plunger which strikes the pill is pointed, thus concentrating the force of the blow to the plunger cap directly on the portion of the pill which lies directly above the blade assembly. The current invention thus provides advantages of safety in use, as the single blade is located in the upper or lower body, where the user is much less likely to be cut by the steel blade within.

The material of the pill splitter may be metal, or, preferably, a high-impact plastic, which will withstand the repeated impact to the cap of the plunger used to effect the split.

The present invention is simple to operate, contains only a single moving part, and is compact and easy to carry in a pocket or purse.

While the invention has been described with reference to specific embodiments, it will be apparent that improvements and modifications may be made within the purview of the invention without departing from the scope of the invention defined in the appended claims.

What is claimed is:

1. A quartering pill splitter comprising:

(a) a pill bed having a recess having a cross section formed within which substantially conforms to the pill shape;

(b) a thin, cruciate cutting blade assembly affixed in a lower body, in proximity to the bed, and further comprising a first blade having a thickness and a second blade at a substantially right angle relative to the first blade, each blade having a cutting edge, and the second blade offset from the first blade by a distance approximately equal to the thickness of the first blade, (c) an upper body, containing one or more linear plunger guides slots; and (d) a plunger, further comprising an upper compression member which slides with respect to the cutting blade assembly, said compression member having a linear, pointed edge which slidingly engages the first blade parallel to its cutting edge, so that when the plunger is suddenly and forcibly slid toward the pill, the pill is first sheared between the compression member and the first blade, and then shears parallel to the second blade.

2. The pill splitter of claim 1, wherein the pill bed further comprises alignment tabs which engage the guide slots, aligning the bed thereby.

3. The pill splitter of claim 2, wherein the cutting blade assembly is disposed directly below the bed.

4. A quartering pill splitter comprising:

(a) a substantially cylindrical bed comprising guide tabs and having a recess formed within having a cross section which substantially conforms to the pill shape;

(b) a thin, cruciate cutting blade assembly disposed in a lower body, in proximity to the bed, and further comprising a first blade having a thickness and a second blade at a substantially right angle relative to the first blade, and offset from the first blade by a distance approximately equal to the thickness of the first blade, and both blades comprising cutting edges, (c) an upper body, integrally affixed to the lower body, and containing one or more linear plunger guides slots in which the guide tabs are engaged, aligning the bed thereby; and (d) a plunger, further comprising plunger guides which slidingly engage the plunger guide slots; and a compression member formed at a lower end of the plunger, the compression member having a pointed lower edge which remains parallel to the first blade as it slides, so that when the plunger is suddenly and forcibly slid toward the pill, the pill is first sheared between the compression member and the first blade, and then shears parallel to the second blade.

5. The pill splitter of claim 4, wherein the upper body, lower body, and pill bed are all cylindrical.

6. The pill splitter of claim 5, wherein the cutting blade assembly is disposed directly below the bed.

* * * * *